United States Patent [19]

Gött et al.

[11] 4,444,227

[45] Apr. 24, 1984

[54] MECHANISM FOR BENDING STRAIGHT WIRES INTO ZIG-ZAGS, IN PARTICULAR FOR MACHINES FOR THE PRODUCTION OF DIAGONAL GRIDS

[75] Inventors: Hans Gött; Josef Ritter; Klaus Ritter; Gerhard Ritter, all of Graz, Austria

[73] Assignee: EVG Entwicklungs-u. Verwertungs-Gesellschaft m.b.H., Graz, Austria

[21] Appl. No.: 320,011

[22] Filed: Nov. 10, 1981

[30] Foreign Application Priority Data

Dec. 2, 1980 [AT] Austria ..... 5885/80

[51] Int. Cl.[3] ..... B21F 1/00

[52] U.S. Cl. ..... 140/105; 72/191

[58] Field of Search ..... 140/105, 112, 3 R, 9; 219/56; 72/190, 191, 387

[56] References Cited

U.S. PATENT DOCUMENTS

| | | | |
|---|---|---|---|
| 755,006 | 3/1904 | Hoxie | 140/105 |
| 2,868,236 | 1/1959 | Smith | 140/105 |
| 4,315,125 | 2/1982 | Schmidt et al. | 219/56 |

FOREIGN PATENT DOCUMENTS 1075191 10/1954 France .

*Primary Examiner*—Francis S. Husar
*Assistant Examiner*—Linda McLaughlin
*Attorney, Agent, or Firm*—Ernest F. Marmorek

[57] ABSTRACT

A mechanism for bending a coplanar family of straight wires into zig-zags comprises deflector rollers for feeding the family of wires longitudinally in parallel with one another, bars adapted to be displaced transversely to the wires and carrying wire deflector pins, and a control device for moving the bars alternately in opposite directions transversely of the wires. In order to avoid sliding of the wires against the deflector pins during the bending operation, each bar is hinged to the one ends of at least two parallel bearer arms of equal length and pivotally supported about axes running perpendicular to the plane of bend. During each bending operation only one bar at a time can be displaced transversely by means of the control device to carry out a working stroke.

6 Claims, 10 Drawing Figures

MECHANISM FOR BENDING STRAIGHT WIRES INTO ZIG-ZAGS, IN PARTICULAR FOR MACHINES FOR THE PRODUCTION OF DIAGONAL GRIDS

The invention relates to a mechanism for bending a coplanar family of straight wires into zig-zags, the mechanism comprising means for feeding the family of wires longitudinally in parallel with one another, bars adapted to be displaced transversely to the wire family and carrying wire-deflector pins at intervals corresponding with the pitch of the wires, and a control device for moving the bars alternately in opposite directions transversely to the feed direction of the wires. Such a mechanism is hereinafter referred to as of the kind described.

Mechanisms of this kind are used in particular for machines for the production of so called diagonal grids in which two families of wires bent alternately in opposite directions into zig-zags are produced and each adjacent pair of these wires are connected together at the adjacent, possibly slightly overlapping, zig-zag crests.

In the case of a mechanism of the kind described known from French Patent Specification No. 1,075,191, the bars carrying the deflector pins are arranged at equal angular intervals around the periphery of a roller and can be displaced in parallel with the axis of the roller. By camtracks arranged at the ends of the roller and engaging with the ends of the bars a number of bars at a time get displaced alternately in opposite directions in such a way that the wires are engaged at intervals from opposite sides, put under tension and with a sliding movement against the pins bent round them to an increasing extent into zig-zags. Through the sliding motion of the wires against the deflector pins during each bending operation, which motion is connected with considerable work due to friction, the pins and wires are heavily loaded and the bending operation extends at any time over a fairly long piece of wire. As a result, not only does heavy wear of the deflector pins occur and the danger of tearing of the wires, but also the points of bend, because of uncontrollable springing back of the wires, turn out to be non-uniform. Diagonal grids produced from wires bent in this way therefore exhibit unsatisfactory rhombic meshes.

The invention is concerned with the problem of eliminating these disadvantages, in such a way that sliding of the wires against the deflector pins during the bending operations is as far as possible avoided.

This problem is solved in accordance with the invention by a mechanism of the kind described further comprising means hinging each of the bars to one end of at least two parallel bearer arms of equal length, and means pivotally supporting the bearer arms about axes extending substantially perpendicular to the plane of bend whereby the bars are displaced transversely to the wires upon swivelling of the bearer arms, and the control device being adapted to cause only one of the bars at a time to be displaced transversely to the wires to make a working bending stroke.

With this improved construction, at each bending operation, because of the movement of the deflector pin doing the bending, and of the piece of wire resting against it, along a circular arc, a relative rolling motion of the pin against the wire occurs, with only a very small sliding component. This sliding component may be still further reduced and even eliminated entirely if the pivotal axes of the bearer arms of each of the bars are arranged at least approximately in alignment with centres of osculating circles of those evolutes which are described by sections of wire of predetermined length forming tangents to deflector pins on successive bars.

In the base of a mechanism in which the bars are arranged at uniform mutual intervals at the periphery of a roller, the pivotal axes of the bearer arms preferably extend radially of the roller and are offset axially of the roller from bar to bar with respect to one another by half the pitch of the deflector pins along the bars.

In another construction the pivotal axes of the bearer arms of at least two of the bars are supported in a member which can move forwards and backwards along the direction of feed of the wires and the deflector pins on the bars can be moved out of the plane of bend e.g., by swivelling or raising the member carrying the bars, in order after each bending operation to enable the return motion of the member carrying the bars.

Further features of the invention and its application to a machine for the production of so called diagonal grids appear from the following description of embodiments by reference to the accompanying drawings, in which.

Figure 1:
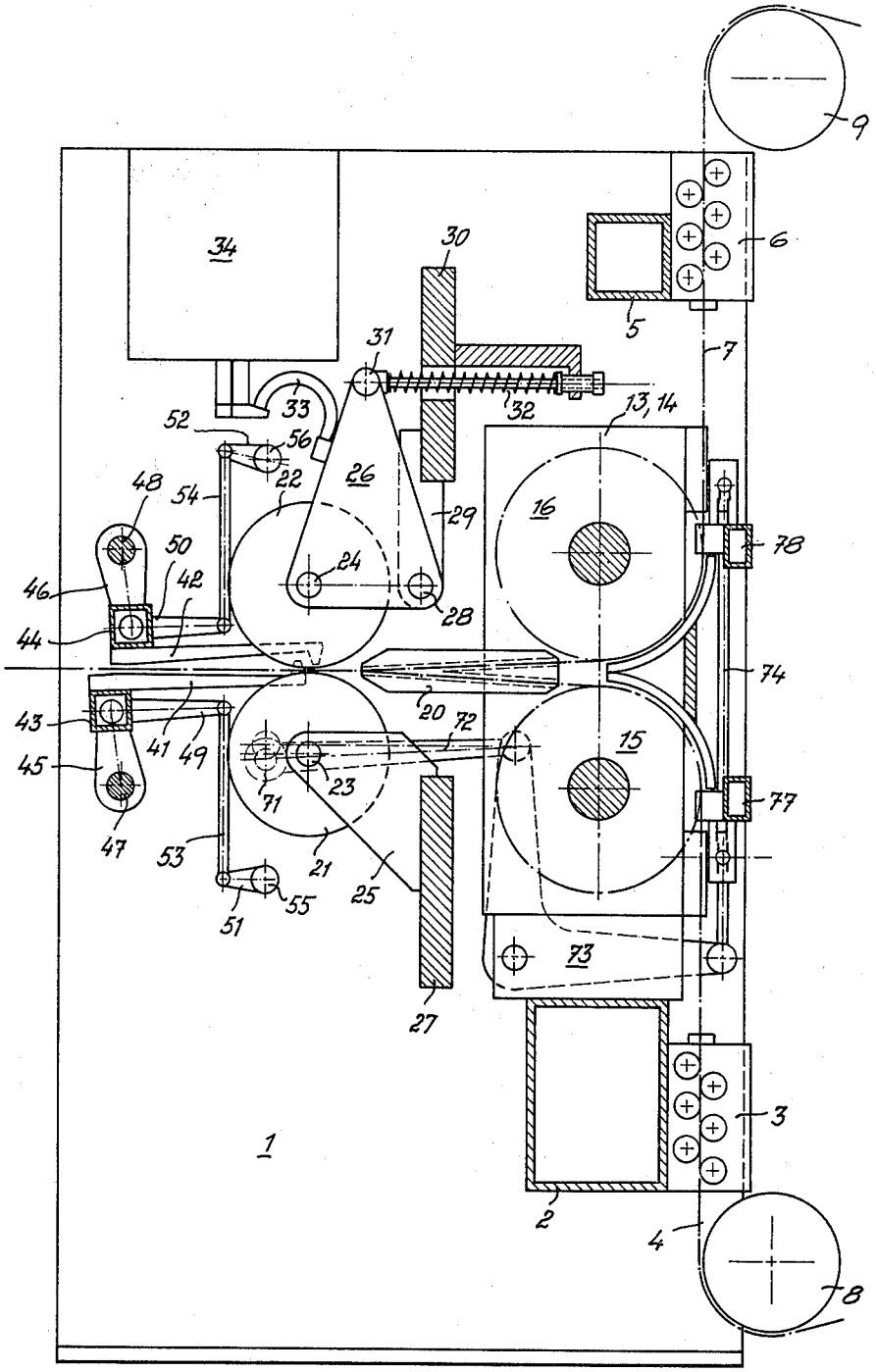
FIG. 1 is a side elevation of a grid-producing machine with a mechanism according to the invention, in section.
Figure 2:
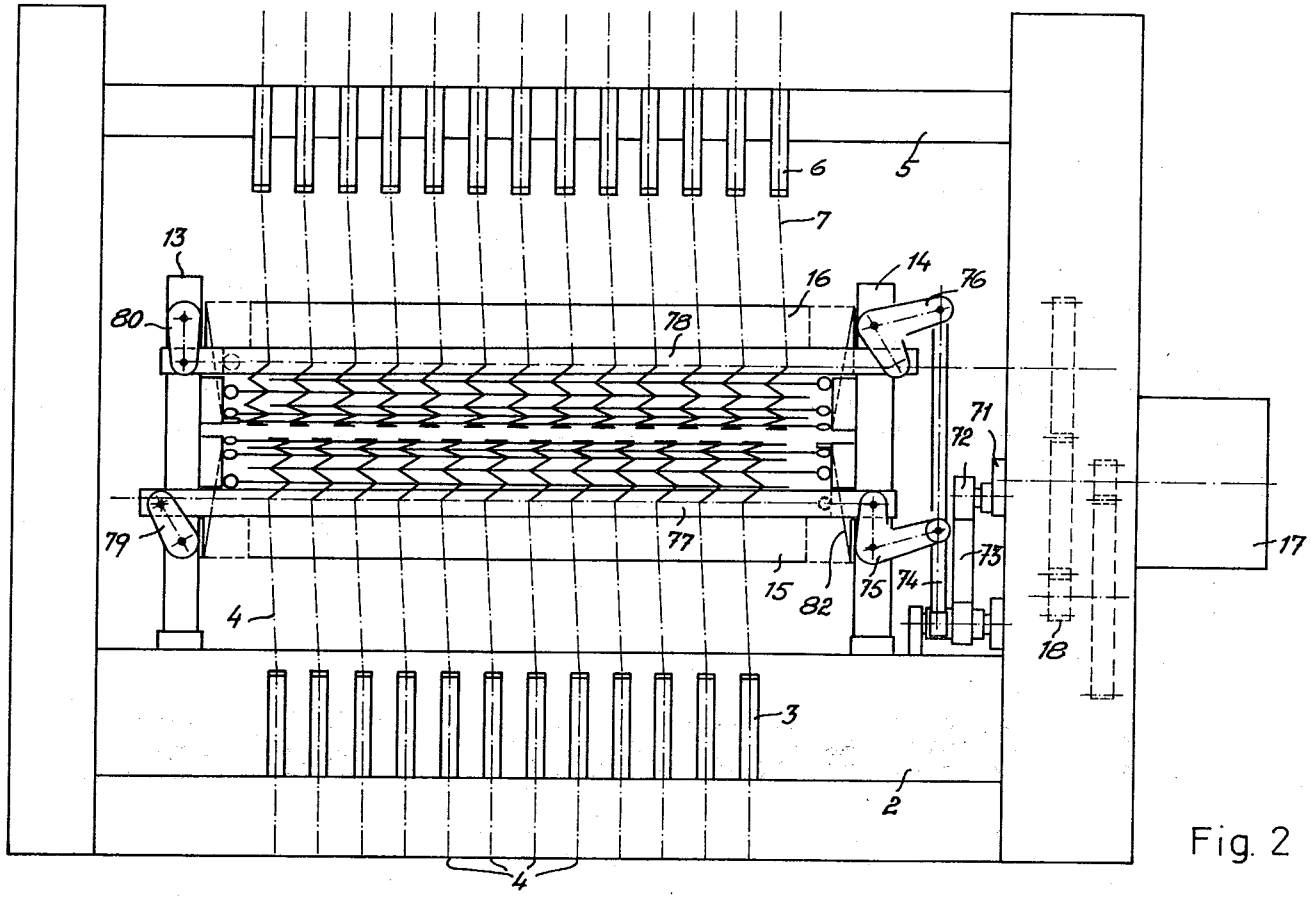
FIG. 2 is an elevation of the same machine from the side of entry of the wire.

As shown in FIG. 1, a lower crossbeam is arranged in a machine frame 1, and straightening devices 3 for the wires of a family of wires 4 are provided along the crossbeam. On a second upper crossbeam 5 straightening devices 6 are arranged for the wires of a second family of wires 7. The two families of wires 4 and 7 are drawn by deflector rollers 8 and 9 from pay-off drums (not shown), led from below and above respectively into a common vertical plane, and thence, after deformation by means of shaping rollers 15,16, fed into a grid-producing apparatus. In FIG. 2 the deflector rollers 8,9 have been omitted for clarity.

Two stands 13,14, in which the two shaping rollers 15,16 are rotatably supported, are arranged on the crossbeam 2. The drive for the shaping rollers and all of the other parts of the machine is effected by a motor 17 via a gear 18 which is only shown diagrammatically.

The wires of the two families of wires 4 and 7 are deflected at the respective shaping rollers 15 and 16 whereby each wire, as may be seen from FIG. 2 and is explained in more detail later, gets bent into a zig-zag along the circumference of the roller. The two zig-zag wire snakes associated with one another, which are formed in this way, and of which one runs along the circumference of the shaping roller 16 and the other along the circumference of the shaping roller 15, lie opposite one another at the end of their path of deflection against the two shaping rollers in such a way that the crests of their waves lying next to one another overlap by a small amount.

In converging guides 20 the family of wire snakes, shaped by the upper shaping roller 16 and the family shaped by the lower shaping roller 15 and drawn off tangentially from the shaping rollers, are guided into a common plane and between connecting tools of a grid-producing apparatus by means of which the adjacent overlapping crests of adjacent wire snakes of the two families are connected together, so that a grid having essentially rhombic meshes is formed.

In the present embodiment of the invention adjacent wire snakes get welded together near their crests by roller electrodes 21,22.

The roller electrodes 21,22 are arranged at intervals and in parallel with one another along shafts 23,24 which are supported in side plates 25,26. The plates 25 are attached rigidly to a beam 27 extending across the width of the machine. The plates 26 are essentially triangular and are connected each at one corner by a hinge 28 to a bearer 29 which in turn is attached to a beam 30 extending transversely across the width of the machine. One of the beams 27 or 30 may be made adjustable for height by means which are not shown because they are generally known, in order to be able to adapt the distance between the roller electrodes 21,22 to different diameters of wire.

The third corner of each plate 26 is connected by a hinge 31 to an adjustable compression spring 32 by means of which the contact pressure of the roller electrodes 22 against the points of cross of the wires may be set as required. Furthermore the roller electrodes 22 are connected by means of flexible supply leads 33 alternately to the two poles of the secondary side of a welding transformer 34. As is already known in the case of welding apparatus, adjacent upper roller electrodes 22 are electrically insulated from one another, whereas the lower roller electrodes 21 are connected conductively together and thus form a passive current bridge.

The advance of the grid is brought about by gripper hooks 41,42 which are attached to beams 43,44 running transversely across the width of the machine. In the end portions of the beams 43,44 there engage pivot pins, which are arranged at the one ends of one-armed levers 45,46; the other ends of these one-armed levers being connected rotationally fixedly to shafts 47,48. By a cam drive which is not shown, the shafts 47,48 are caused to swing to and fro, that is, in such a way that the end of the one-armed lever 45 carrying the beam 43 is at any time moving away from the roller electrodes 21,22 whilst the end of the one-armed lever 46 carrying the beam 44 is moving towards the roller electrodes 21,22 and vice versa.

At the same time, via two one-armed levers 49,51 and a pushrod 53 and via two one-armed levers 50,52 and a push rod 54 respectively the beams 43 and 44 are swivelled about their longitudinaly axes, so that the beam moving away from the roller electrodes 21,22 at any time (in the working phase assumed above, the beam 43), is swivelled in such a way that its gripper hooks 41 come into engagement with the grid meshes, whilst at the same time the gripper hooks 42 of the other beam 44 are swung out of engagement with the grid, and vice versa. The one-armed levers 51,52 are for this purpose rotationally fixedly on shafts 55,56 which are caused, by cam drives, to swing to and fro.

The drive for the actual deforming tools is taken off an eccentric 71 and transmitted by a connecting rod 72 to the one arm of a bellcrank 73, to the other arm of which is hinged a pushrod 74. The pushrod 74 is, as shown in FIG. 2, connected by a hinge to the one arm of two further bellcranks 75,76, to the other arms of which are hinged in each case the end of a further pushrod 77,78. The ends of the pushrods 77,78 remote from the bellcranks 75,76 are attached to the stand 13 by hinges and rocker arms 79,80.

Figure 4:
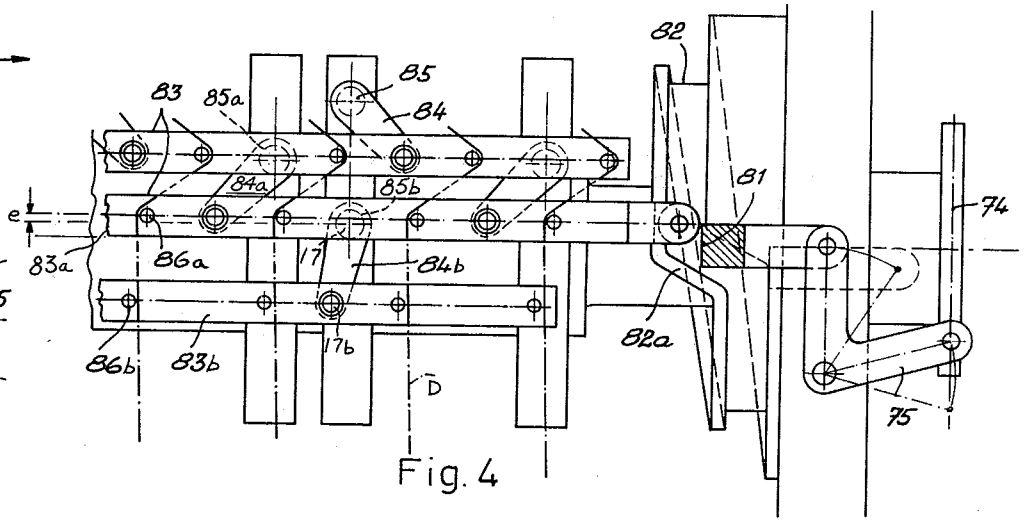
FIG. 4 shows the associated device for the displacement of the bars along the shaping roller, in elevation.
Figure 5:
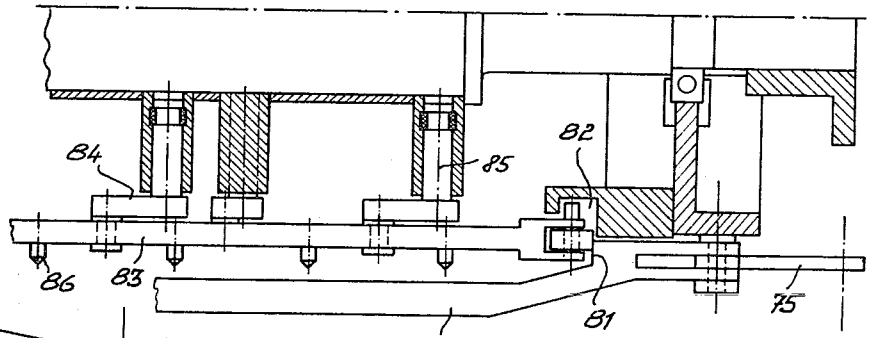
FIG. 5 is a plan corresponding to FIG. 4.

As shown in FIGS. 4 and 5 the pushrods 77,78 have, near their two ends, components 81 acting as abutments, which in the working position engage partially in a camtrack 82. Such a camtrack 82 is provided at both ends of each of the two shaping rollers 15,16 and the end of bars 83 arranged along the periphery of the shaping rollers 15,16 come, by means of guide rollers, alternately into engagement with the camtracks, one bar with the camtrack lying on the righthand side of the machine, and the next bar with the camtrack lying on the lefthand side of the machine.

Figure 3:
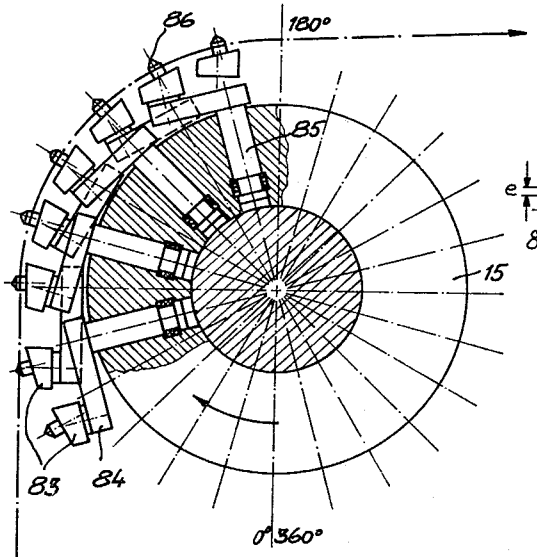
FIG. 3 is a section through a shaping roller.

Each of the bars 83, along which deflector pins 86 are provided at intervals for each wire, is, as shown in FIG. 3, hinged to the one ends of at least two parallel bearer arms 84 of equal length, the other ends of which are fastened to rotatable pivot pins 85 arranged radially in the shaping rollers 15,16.

With uniformly progressive rotation of the shaping rollers 15,16, as soon as the guide roller of one of the bars 83 arrives in the deformation region **82*a* of the associated camtrack, the associated bellcrank, for example the bellcrank 75 in FIG. 4, executes a swinging motion by which the pushrod 77 together with its abutment 81 is displaced in the direction of and by the amount of the required parallel displacement of the bar 83 to correspond with the deformation of the wire. During this motion the abutment 81 on the pushrod 77 engages the guide roller of the bar and brings it into its new position against the raised part of the camtrack 82**.

One of the prerequisites for enforcing a deformation of the wires without the wires sliding along the deflector pin 86 on one of the bars 83, consists in there always being in any given interval of time only one single bar 83 making a working stroke upon being displaced in parallel with itself, whilst the remaining bars are making an idle stroke or are at rest. The parallel working displacements of the individual bars must therefore be effected one after another and in each case by an amount which is equal to the amplitude of the required zig-zag shape of the wires, and must furthermore be effected during a period of time during which the shaping rollers 15,16 pass through an angle which is equal to that fraction of a complete circle which results from dividing the full circle by the number of bars 83 around the periphery of a shaping roller.

As regards this requirement it may happen that the deformaton region **82*a* of the camtrack, which is also dependent upon the required shape of the mesh of the grid, includes with the sections of track lying in front of and behind it in the direction of rotation of the shaping rollers, such a steep angle that this region of the camtrack could not be traversed by the guide rollers of the bars 83 because of self-jamming without cooperaton of the movable abutments 81. This may be seen particularly clearly from the development of the camtrack 82 illustrated in FIG. 6**.

Figure 6:
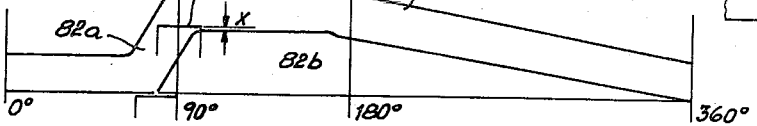
FIG. 6 shows the development of the camtrack according to FIGS. 4 and 5.

In FIG. 6 there may further be seen a distance X by which the abutment 81 is moved beyond the necessary amplitude in order to take into account springing back of the bent wire after unloading by the deflector pins 86. Finally in passing along the region 82*b* of the curve, through a jerky return of the bar 83 by a small amount, a frictionless tangential removal of the wires bent into zig-zags from the deflector pins after partial wrapping round the shaping rollers 15,16 is made possible.

As may further be seen from FIG. 2, the arms of the bellcranks 75,76 actuating the pushrods 77,78 and the rocker arms 79,80 are arranged at an angle to one another in such a way that it is always so that the one of these components at the side next to which an abutment 81 becomes active for the parallel displacement of a bar 83, is swivelled out of a rest position running at an acute angle to the plane of revolution of the shaping rollers 15,16 into a working position in parallel with this plane of revolution. As a result that end of the pushrods 77,78 becoming active at a given instant for the parallel displacement of one of the bars, is moved at that end both along the shaping roller and with a component in the direction of rotation of the shaping roller, so that the abutments 81 may be made narrow because they move along with the guide rollers, and therefore guide rollers of further bars 83, running after them in the same camtrack 82, do not get impeded by the abutments. In FIG. 4 the two extreme positions of the abutment 81 are shown in solid and dotted lines respectively.

Figure 7:
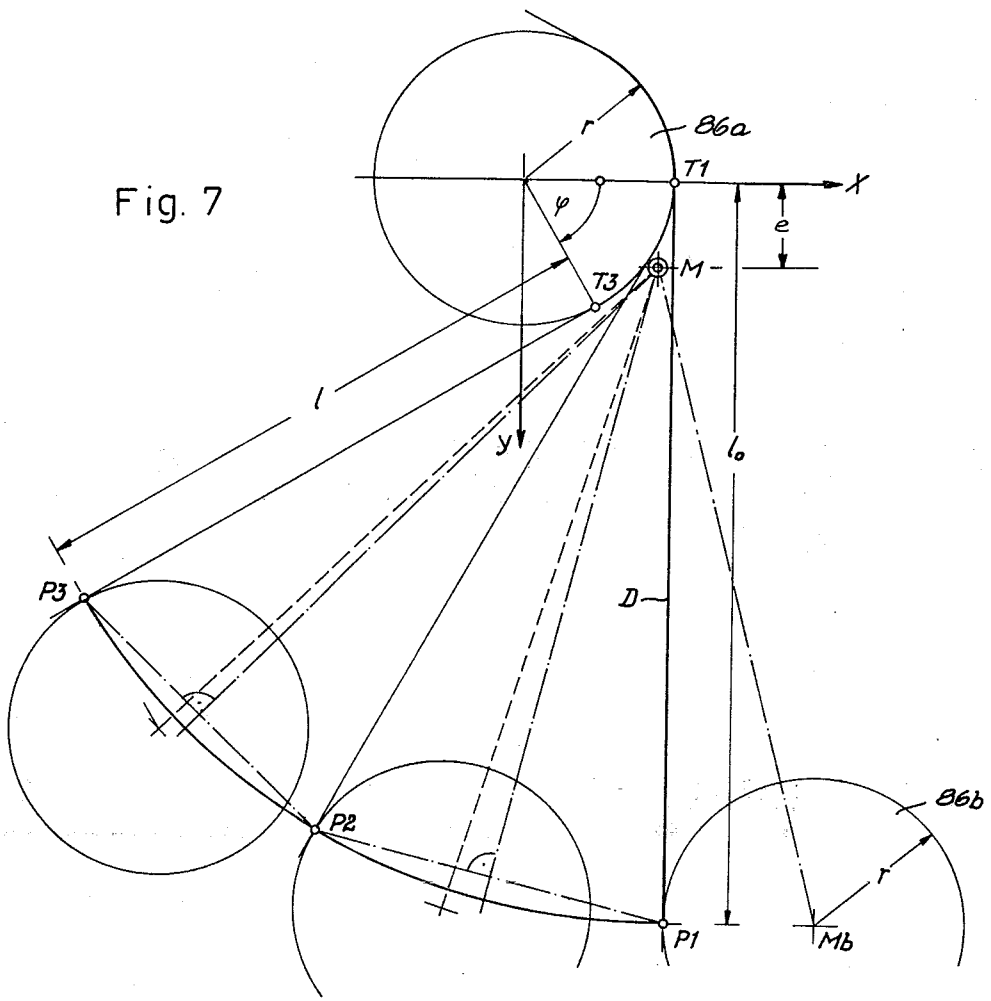
FIG. 7 illustrates the kinematics of the bending processes.

With the aid of FIG. 7 the optimum bending of the wire between two successive deflector pins may now be explained. A deflector pin 86*a* has moved out of its starting position (not shown) into its final position shown in FIG. 7. The wire D engaged by this deflector pin comes from one of the deflector rollers 8,9 meets the pin 86*a* at a tangent at the point T1, and partially wraps round it. At the point P1 lying at the distance $l_o$ from the point T1 the wire D is touched by the next deflector pin 86*b* still lying in its rest position Mb. If the wire D is, as illustrated, carried clockwise around the deflector pin 86*a* which during this motion is stationary with respect to the transverse direction X then the point which is being considered as fixed along the wire D runs one after another through the points P1-P2-P3 lying on a evolute of the circumferential circle of the pin 86*a*, so that the length l of the span T3-P3 is shorter only by the r arc 0 than the length $l_o$ of the span T1-P1.

If this motion is to be caused by the second deflector pin 86*b* and in doing so the additional condition is still to be fulfilled such that the wire during the motion may not slide along the pin 86*b*, then the points P1 to P3 must at the same time lie on an osculating circle of the evolute. This is the case when the deflector pin 86*b* is moved along a circular path about a point M which lies at the point of intersection of normals erected at the centres of the chords P1-P2 and P2-P3.

This can be further explained with reference to FIG. 7 as follows: If a wire of the length $l_o$ is wrapped around a mandrel 86*a* of given diameter, the wire's end will pass the points P1, P2, P3 one after the other. If a tangent line is drawn from any one of these points to the periphery of the mandrel 86*a*, namely, the tangent line P3-T3, the length l of the tangent line is a function of the angle $\phi$, $l=l_o-r.\text{arc}\ \phi$.

The points P1, P2, P3, therefore, define a curve, the radius of which gradually decreases in dependence on the angle $\phi$. A section of such a curve can be very closely approximated by a circle—that is the circle which has been denoted as the osculating circle—which is drawn through the points P1, P2, P3 and the center of which is M. At the points P1, P2, P3 the osculating circle will coincide with the given curve. Between adjacent points there will exist only a very small deviation between a circle and the curve as shown.

The axes of the pivot pins 85 of the bearer arms 84 which carry that bar 83 upon which the deflector pins 86*b* are arranged, must therefore intersect that generatrix of the cylindrical surface of the shaping roller upon which the point M is lying and the centrelines of these bearer arms 84 must at the instant of touching of the wires D by the pins 86*b* run in parallel with the straight line M–Mb.

This can be further explained by assuming that the bending pins 86*a* have just come to rest after finishing their bending stroke.

The axes of the pivot pins 85*b* of the bearer arms 84*b* which carry the bar 83*b* upon which the deflector pins 86*b* are arranged which, in the machine's cycle of operation, are next to engage the wire, in order to bend it around the then stationary pins 86*a* must intersect the surface of the cylindrical shaping rollers 15 along a generatrix. This surface is parallel to and disposed, with respect to the shaping roller's sense of rotation, a small distance "e" behind the generatrix along which the deflector pins 86*a* have come to a rest upon termination of their bending sweep.

In general terms the distance "e" of the generatrices along which the deflector pins 86*a*, 86*b* of any bar 83*a*, 83*b* will rest after termination of their bending sweep, from the generatrices along which the pivot pins 85*b*, 85*a* of the bearer arms 84*b*, 84*a* of the next set of pending pins 86*b*, 86*a* to engage and bend the wire are located, depends on the desired shape of the bent wire, that is, on the desired angle of bend. For the illustration shown in FIG. 7, and for its geometry, "e" lies within the limits:

$$0.17r \leqq e \leqq 0.53r,$$

"r" being the radius of the deflector pins, for a bending angle within the limits:

$$20° \leqq \phi \leqq 60°.$$

Alternately, the distance "e" of the two generatrices in question is defined by the distance of the two points "M", that is the centers of the osculating circles along which the deflector pins 86*b* move, from the centers of the terminal positions of the deflector pins 86*a*, measured in the direction of the y-coordinate of FIG. 7, namely, in circumferential direction of the shaping rollers 15.

Finally, at the moment when the deflector pins 86*b* touch the wire in order to begin their bending operation, the center lines M–Mb of the bearer arms 84*b* must enclose an angle with the wire D, the size of which depends on the length $l_o$, the diameter of the deflector pins and the desired angle of bend, as seen from FIG. 7.

Figure 8:
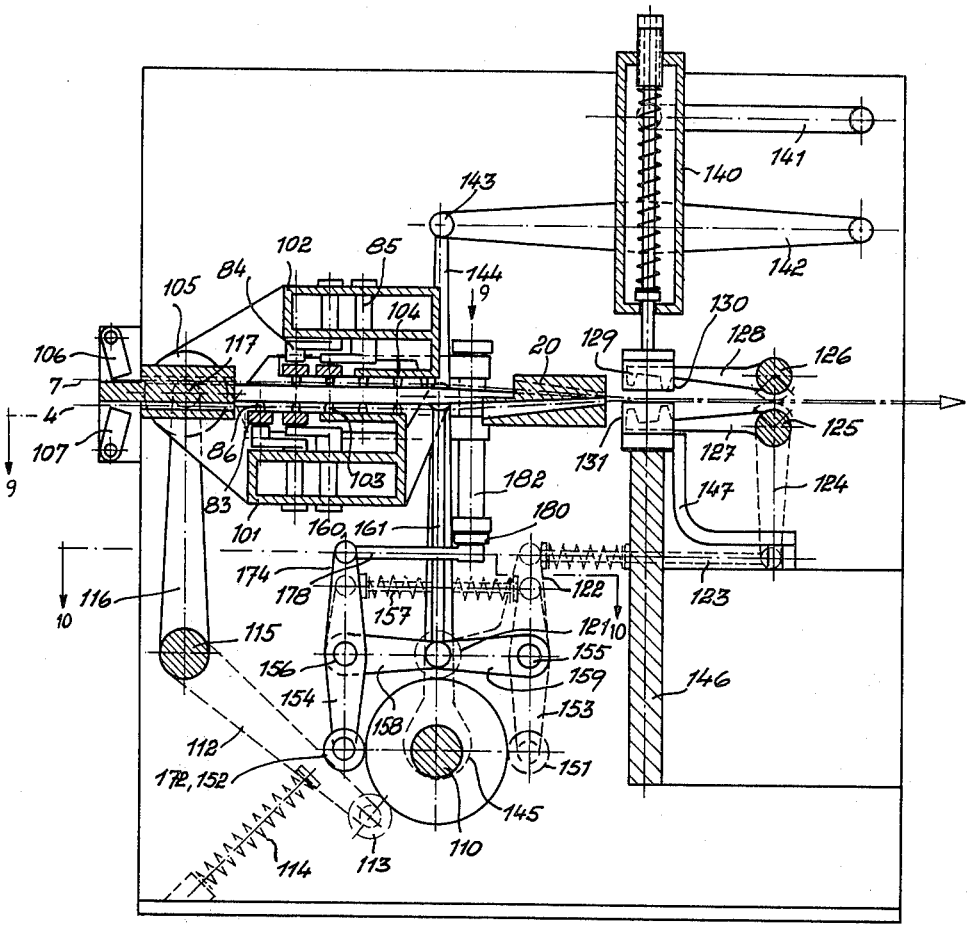
FIG. 8 is a sectional view, showing a modified grid-producing machine, taken on the line 8—8 of FIG. 10.
Figure 9:
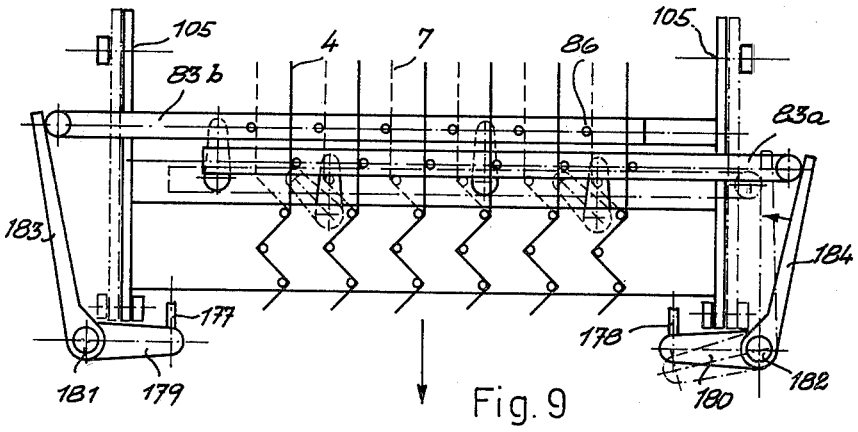
FIG. 9 is a plan of the associated device for the displacement of the rails; and, FIG. 10 shows in elevation the cam arrangement of the machine of FIG. 8.
Figure 10:
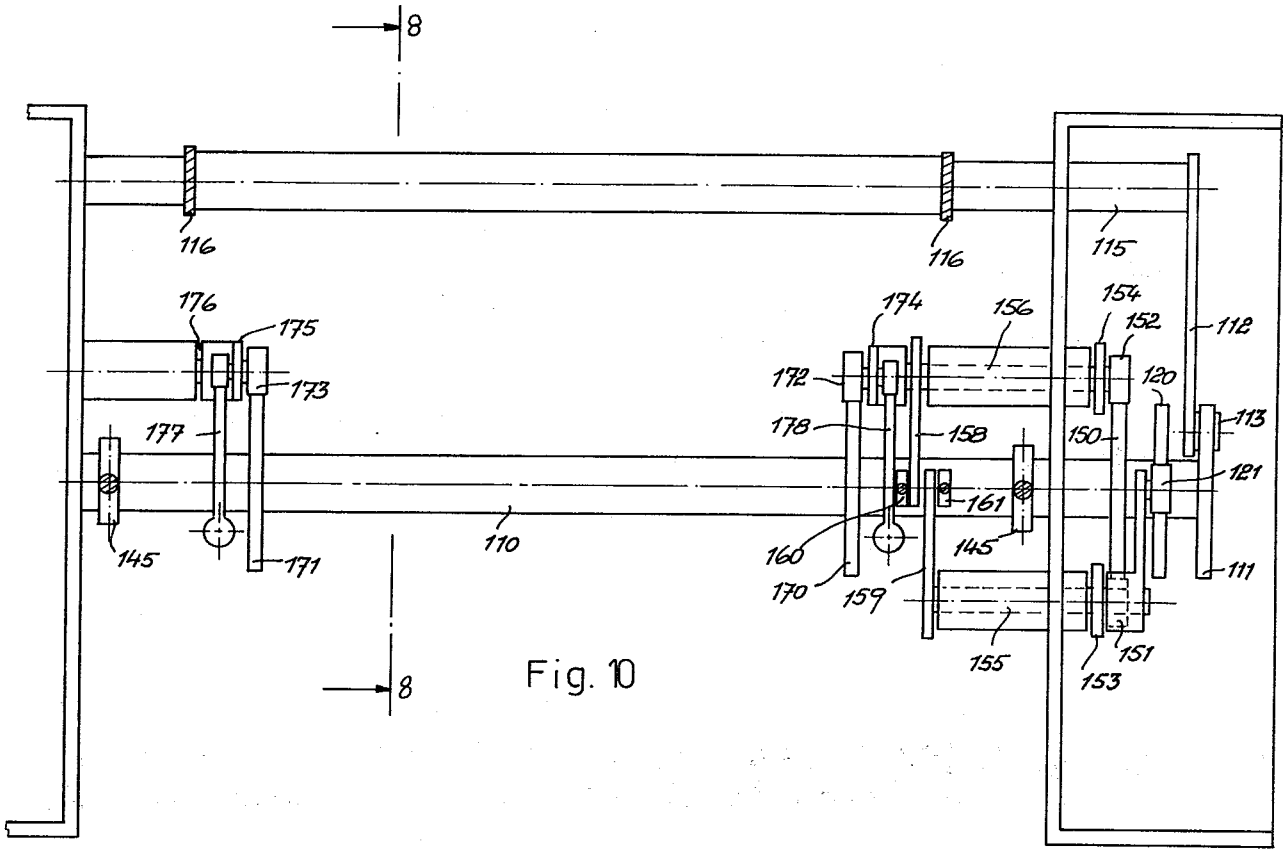

FIGS. 8 to 10 show another embodiment of a mechanism according to the invention. The actual bending process in the case of this embodiment proceeds according to the same principle as in the case of the embodiment shown in FIGS. 1 to 7 but instead of the shaping rollers 15,16 two beams 101,102 are provided which are moved forwards and backwards in parallel with the plane of motion of the families of wire 4,7 fed to them in parallel planes.

On each of the two beams 101,102 at least two pairs of pivot pins 85 are provided, which in the same way as shown in FIGS. 3 to 5 carry, on bearer arms 84, bars 83 having deflector pins 86. In addition to these movable deflector pins 86, on each of the two beams 101,102 at least two rows of immovably fixed feed pins 103 are also arranged, which engage in already shaped points of bend in the wires of the families of wires 4,7 and thereby feed the already deformed wires into converging guides 20 and through these to the welding station.

The two beams 101,102 are connected together by means of hinges 105 and may be opened and closed pivotally about these hinges like the cheeks of tongs. In the direction of wire feed in front of the hinges 105 of the beams 101,102, automatic clamping devices 106,107 are arranged one for each wire having to be fed. During the forward motion of the beams 101,102 these devices seize the approaching wires of the families of wires 4,7 and draw them off supply drums (not shown) but during the return motion of the beams 101,102 slide along the wires without taking them with them.

The whole drive in the case of this embodiment of the invention is taken off a motor-driven shaft 110. On this shaft 110 is seated a first cam 111 (FIG. 10) which actuates a one-armed lever 112 via a pick-up roller 113. The one-armed lever 112 loaded by a return spring 114 is rotationally fixed to the end of a shaft 115 along which two further one-armed levers 116 are keyed. The levers 116 engage with slideblocks 117 in appropriately shaped slots in the region of the hinge of the beams 101,102 and impart to these beams the common forwards and backwards motion already mentioned.

Via a second cam 120 (FIG. 10) and an associated pick-up roller 121 a spring-loaded bellcrank 122 is actuated and, via a pushrod 123, acts upon a lever 124. The lever 124 is connected rotationally fixed to a shaft 125 which, via gears which are only indicated, is connected in rotation to a shaft 126 in parallel with it and cooperating with it.

The two shafts 125,126 carry a number of one-armed levers 127,128 which are provided with teeth 129 which engage in the meshes of the grid at the side of electrodes 130,131, that is, before these come into action, and in doing so bring the overlapping crest regions intended for welding, of two wires adjacent to one another and bent into zig-zags, into the correct relative position with respect to one another. After the welding process the levers 127,128 swing back again into their rest position and release the meshes of the grid for onwards conveyance of the grid.

The electrodes 130,131 are made as elongate bars in order to be in the position to be able at any time to seize two points of weld of two adjacent wires overlapping at their zig-zag crests which are to be welded. The upper electrodes 130 are arranged in known manner on an electrode beam 140 extending across the width of the machine and able to move up and down, and are supported with respect to it by springs. The electrode beam 140 is hinged onto two parallel levers 141,142 of equal length and pivotally supported, of which the lever 142 is prolonged beyond the electrode beam 140 and connected by a hinge 143 to a connecting rod 144 the other end of which is connected to an eccentric 145. The electrode beam 130 is thereby during the welding cycle lowered onto the grid meshes and raised from them again. The electrodes 130 are connected together conductively so that the whole of the electrode 130 forms a passive current bridge.

The lower electrodes 131 are likewise in known manner arranged along a beam 146 fixed to the machine and extending across the width of the machine and insulated electrically with respect to this beam and also with respect to one another. The individual electrodes are connected conductively via flexible supply leads 147 to the secondary sides of transformers which are not shown.

A third cam 150 (FIG. 10) cooperates with two pick-up rollers 151,152. Each of these pick-up rollers is arranged at the end of a two-armed lever 153,154 which between its two arms is keyed onto a shaft 155 or 156 respectively. The ends of the two-armed levers 153,154 opposite from the pick-up rollers 151,152 are connected together by a compression spring 157. The cam 150 is shaped in such a way that the levers 153,154 are always pivoted by equal amounts of angle and in the same direction.

To the opposite ends of each shaft 155,156 is connected a one-armed lever 158 and 159 respectively, to the other end of which a pushrod 160 and 161 respectively is hinged. The other ends of these pushrods 160,161 are connected to each one of the beams 101,102 at the opposite side from the hinges 105. Since in the case of turning of the levers 153,154 in the same direction, for example, the pushrod 160 moves downwards but the pushrod 161 moves upwards, by this lever system a tongs-like opening and closing of the beams 101,102 about the hinges 105 is brought about. The pushrods 160,161 and the one-armed lever 116 must be parallel with one another in every phase of movement of the beams 101,102.

On the shaft 110 yet another two cams 170,171 (FIG. 10) are provided, and cooperate with pick-up rollers 172,173 which in FIG. 8 lie in alignment with the pick-up roller 152. These pick-up rollers are hinged at the bottom ends of two-armed levers 174,175 of which the lever 174 is supported to be able to rotate freely on the shaft 156, whereas the lever 175 is supported on a separate shaft 176. To the arms of the levers 174,175, remote from the rollers 172,173, pushrods 177,178 are hinged, which, as shown in FIG. 9, are connected via levers 179,180 to shafts 181,182.

To the top ends of the shafts 181,182 abutments 183,184 made as control levers are connected rotationally fixed, and displace the bars 83 out of their rest position into their working position for the bending process. In doing so the control levers 183,184 act against the bars 83 which are loaded by springs (not shown). These springs then also bring about the return of the bars 83 as well as of the control levers 183,184 and their whole driving system as soon as the cams 170, 172 allow return of the control levers 183,184. Hence this system takes over the function of the abutments 81 and of the camtracks 82 of the first embodiment.

This mechanism works as follows. As soon as a feed and bending step has been completed the levers 127, 128 swing into the working position, the teeth 129 engage in the crests of the zig-zags of adjacent wires, lying in the welding region, and centre them so that the crests of the zig-zags of adjacent wires, of which one belongs to the family of wires 4 and the other to the family of wires 7 respectively, overlap by a predetermined amount. Now the eccentrics 145 move the connecting rods 144 downwards, whereby the electrode beams 140, hinged to the levers 141,142, are likewise moved downwards and the electrodes 130 get pressed against the material which is to be welded. After switching on the welding current a weld is carried out.

At the same time the components 150 to 161 are actuated in such a direction that the beams 101,102 are swivelled about the hinges 105 in opposite directions so that they move apart. The feed pins 103,104, and the deflector pins 86 come out of engagement with the already bent wires of the families of wires 4 and 7. Via the components 112 to 117 the expanding spring 114 brings about a movement of the beams 101,102 in FIG. 8 from the right towards the left, whereupon the clamps 106,107 slide along the wires of the families of wires 4 and 7. Simultaneously with this movement of the beams 101,102 the control levers 183,184 are controlled via the components 170 to 175 and 177 to 182 in such a way that they can submit to the action of the springs loading the bars 83 and thereby allow a return of the bars 83 into their rest position.

After reaching their limiting position at the left in FIG. 8 the components 150 to 161 again bring about a closing of the beam 101, 102 by a pivoting motion about the hinges 105, opposite to that first mentioned. The feed pins 103,104 engage in zig-zag crests already shaped in the wires and the deflector pins 82 lying in the rest position come sideways to lie next to the approaching straight wires which are associated with them. As soon as the feed pins 103,104 are in engagement again with already deformed wires, the teeth 129 are brought by the action of the components 120 to 127 out of engagement with the grid and at the same time the electrodes 130 likewise are raised by the components 140 to 145 and release the grid too.

Starting from the cam 111 the components 112 to 117 now start to move the beams 101,102 from the left towards the right in FIG. 8. The clamping devices 106,107 seize the approaching wires and carry them with them in their movement. The feed pins 103,104 engaging in already shaped zig-zag crests of the wires feed the already bent wires through the guide 20 to the welding station. Starting from the cam 170 which has now become active, the control lever 184 is set in action via the even-numbered components 172 to 182 and then starting from the cam 171 the control lever 183 is set in action via the odd-numbered components 173 to 181. These two control levers becoming active one after another move the bars 83*a*, 83*b* in the direction of deformation of the wires in opposite senses whereupon once more as in the case of the embodiment as in FIGS. 1 to 7 the bearer arms 84 carrying the control levers get swivelled about their pivot pins 85, after the conclusion of the deformation process which has just been described, the cycle starts afresh.

The embodiments and examples of application of the invention as illustrated may be subject to various modifications. In particular mechanisms in accordance with the invention may also be employed for the production of members of girders and the like. Again, in the case of grid producing machines, instead of the roller electrodes illustrated for electrical resistance welding any other kind of connection of the crests of the deformed wires overlapping one another may also be applied, say, by gluing, by connection by means of clamping parts, or the like.

What we claim is:

1. In a mechanism for bending a coplanar family of straight wires into zig-zags, said mechanism comprising means for feeding said wire family longitudinally in parallel with one another, bars adapted to be displaced transversely to said wire family and carrying wire-deflector pins at intervals corresponding with the pitch of said wires, and a control device for moving said bars alternately in opposite directions transversely to the feed direction of said wires, the improvement comprising means hinging each of said bars to one ends of at least two parallel bearer arms of equal length, and means pivotally supporting said bearer arms about axes extending substantially perpendicular to the plane of bend whereby said bars are displaced transversely to said wires upon swivelling of said bearer arms, and said control device being adapted to cause only one of said bars at a time to be displaced transversely to said wires to make a working bending stroke.

2. A mechanism according to claim 1, wherein said pivotal axes of said bearer arms of each of said bars are arranged at least approximately in alignment with centres of osculating circles of those evolutes which are described by section of wire of predetermined length forming tangents to deflector pins on successive bars.

3. A mechanism according to claim 1 or claim 2, wherein said bars are arranged to uniform mutual intervals at the periphery of a roller, and said pivotal axes of said bearer arms extend radially of said roller and are offset axially of said roller from bar to bar with respect to one another by half the pitch of said deflector pins along said bars.

4. A mechanism according to claim 1 or claim 2, wherein said pivotal axes of said bearer arms of at least two of said bars are supported in a member, means are provided to move said member forwards and backwards along the direction of feed of said wire family, and means are provided for moving said deflector pins out of the plane of bend after a bending working stroke.

5. A mechanism according to claim 1 or claim 2, further comprising abutments which are displaceable transversely to said wires and which engage ends of said bars for the transverse displacement thereof.

6. A machine for the production of diagonal grids, said machine comprising a connection station with means for connecting at adjacent zig-zag crests two symmetrical families of zig-zag wires in a common plane, and two mechanisms according to claim 1 or claim 2 positioned one on each side of said plane for producing said zig-zag wire families.

* * * * *